US010428414B2

(12) United States Patent
Nakayama et al.

(10) Patent No.: US 10,428,414 B2
(45) **Date of Patent: *Oct. 1, 2019**

(54) CARBURIZED COMPONENT

(71) Applicant: DAIDO STEEL CO., LTD., Nagoya-shi, Aichi (JP)

(72) Inventors: Kyohei Nakayama, Aichi (JP); Yasuaki Sakai, Aichi (JP); Toshiyuki Morita, Aichi (JP); Keisuke Inoue, Aichi (JP)

(73) Assignee: DAIDO STEEL CO., LTD., Aichi (JP)

( * ) Notice: Subject to any disclaimer, the term of this patent is extended or adjusted under 35 U.S.C. 154(b) by 108 days.

This patent is subject to a terminal disclaimer.

(21) Appl. No.: 14/899,878

(22) PCT Filed: Jun. 24, 2014

(86) PCT No.: PCT/JP2014/066717

§ 371 (c)(1),
(2) Date: Dec. 18, 2015

(87) PCT Pub. No.: WO2014/208562

PCT Pub. Date: Dec. 31, 2014

(65) Prior Publication Data

US 2016/0145732 A1 May 26, 2016

(30) Foreign Application Priority Data

Jun. 26, 2013 (JP) ..... 2013-134262
Apr. 8, 2014 (JP) ..... 2014-079166

(51) Int. Cl.

| | |
|---|---|
| ***C23C 8/22*** | (2006.01) |
| ***C21D 9/28*** | (2006.01) |
| ***C21D 9/32*** | (2006.01) |
| ***C21D 9/40*** | (2006.01) |
| ***C22C 38/60*** | (2006.01) |
| ***C21D 9/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |
| *C21D 1/06* | (2006.01) |

(52) U.S. Cl.

CPC ..... *C23C 8/22* (2013.01); *C21D 9/0068* (2013.01); *C21D 9/28* (2013.01); *C21D 9/32* (2013.01); *C21D 9/40* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C22C 38/50* (2013.01); *C22C 38/54* (2013.01); *C22C 38/60* (2013.01); *C21D 1/06* (2013.01); *C21D 2211/004* (2013.01)

(58) Field of Classification Search

CPC .. C21D 1/06; C21D 2211/004; C21D 9/0068; C21D 9/28; C21D 9/32; C21D 9/40; C22C 38/00; C22C 38/002; C22C 38/02; C22C 38/04; C22C 38/06; C22C 38/42; C22C 38/44; C22C 38/48; C22C 38/50; C22C 38/54; C22C 38/60; C23C 8/22

See application file for complete search history.

(56) References Cited

U.S. PATENT DOCUMENTS

| | | | | |
|---|---|---|---|---|
| 8,123,873 | B2 | 2/2012 | Mizuno et al. | |
| 8,475,605 | B2 * | 7/2013 | Kubota | C21D 9/32 148/219 |
| 2010/0084051 | A1 | 4/2010 | Mizuno et al. | |
| 2010/0126632 | A1 | 5/2010 | Morita et al. | |
| 2013/0146180 | A1 * | 6/2013 | Kubota | C21D 1/06 148/219 |
| 2013/0288838 | A1 | 10/2013 | Kato et al. | |

FOREIGN PATENT DOCUMENTS

| | | |
|---|---|---|
| CN | 101535522 A | 9/2009 |
| CN | 102066586 A | 5/2011 |
| JP | 8-199303 | 8/1996 |
| JP | 9-78184 | 3/1997 |
| JP | 2001-303174 | 10/2001 |
| JP | 2006-213951 | 8/2006 |

(Continued)

OTHER PUBLICATIONS

Japanese Industrial Standard, Methods of Austenite Grain Size Test for Steel, JIS G0551 (Year: 1977).*

International Search Report issued in PCT/JP2014/066717, dated Sep. 30, 2014, along with an English translation thereof.

Chinese office Action issued with respect to Application No. 201480037046.9, dated Jan. 11, 2017.

*Primary Examiner* — Jenny R Wu

(74) *Attorney, Agent, or Firm* — Greenblum & Bernstein, P.L.C.

(57) ABSTRACT

The present invention provides a carburized part having a total amount of TiC, AlN and ZrC, which are precipitate particles, of $4.5\times10^{-10}$ mole or less per 1 $mm^2$ of grain boundary area of prior austenite grains after carburization. According to the present invention, it is possible to provide a carburized part which allows effective inhibition of abnormal grain growth in spite of a carburizing treatment and makes it possible to solve the problem of reduction in properties caused by abnormal grain growth.

6 Claims, 3 Drawing Sheets

(56) References Cited

FOREIGN PATENT DOCUMENTS

| | | | | | |
|---|---|---|---|---|---|
| JP | 2007-31787 | | | 2/2007 | |
| JP | 2008-291298 | | | 12/2008 | |
| JP | 2009-46722 | | | 3/2009 | |
| JP | 2009-114484 | | | 5/2009 | |
| JP | 2009114484 | A | * | 5/2009 | |
| JP | 2010-229508 | | | 10/2010 | |
| JP | 2011-208201 | | | 10/2011 | |
| JP | 2013-28860 | | | 2/2013 | |
| JP | 2013-227607 | | | 11/2013 | |
| WO | WO-2011114836 | A1 | * | 9/2011 | ..... C21D 9/32 |

* cited by examiner

PRESENT INVENTION

COMPARATIVE EXAMPLE

ONO-TYPE ROTATION BENDING FATIGUE TEST PIECE

CARBURIZED COMPONENT

TECHNICAL FIELD

The present invention relates to a carburized part, and specifically relates to a carburized part having a well-ordered grain structure in which the sizes of crystal grains are uniform.

BACKGROUND ART

For example, for mechanical parts such as gears, bearing parts and shafts to be used in automobiles, JIS steel types such as SCr420 are generally used after having been processed into the shapes of parts and then subjected to a surface-hardening treatment by carburization hardening to improve abrasion resistance, fatigue strength and the like.

The carburization hardening is a high-temperature, long-duration heat treatment that is likely to cause coarsening of crystal grains.

For this reason, various studies and proposals to prevent crystal grains from becoming coarse have been conventionally made.

A technique of pinning grain boundaries by precipitating particles such as AlN in a dispersed state at a manufacturing step before a carburizing treatment has been widely known as a useful technique for preventing crystal grains from becoming coarse.

For example, techniques of this kind are disclosed in, for example, Patent Document 1 and Patent Document 2 below.

However, such techniques which allow pinning of grain boundaries by utilizing precipitate particles are incapable of sufficiently preventing an abnormal grain growth in which abnormal coarsening of crystal grains occurs locally.

The term "abnormal grain growth" used herein refers to a phenomenon occurring due to a cause that, though a pinning force of precipitate particles is greater than a driving force for crystal grain growth in the initial carburizing stage, the magnitude relation between these forces comes to reverse and the driving force for crystal grain growth becomes greater than the pinning force of precipitate particles in the middle of the carburizing. Such a reversal of these forces takes place through a cause that the pinning force is reduced by solid solution formation of precipitate particles during the carburizing, by coarsening of precipitates through Ostwald growth, and the like.

In addition, as to the parts which are subjected to cold forging, a distribution of plastic distortions is introduced into the inside of the parts at the time of the forging, and a reversal of magnitude takes place between the pinning force and driving force of crystal grain growth in regions where the distortion is great, thereby causing abnormal grain growth of crystal grains.

FIG. 1(B) shows the occurrence of abnormally grown grains model-wise.

(a) of FIG. 1(B) shows a state at the initial stage of carburization, and p represents a precipitate particle (a pinning particle). In the state at the initial stage of carburization, a large number of precipitate particles p are interposed between grain boundaries, and the grain boundaries between crystal grains q are pinned and restrained, thereby inhibiting the crystal grains q from growing to a larger size.

However, some of the precipitate particles p pinning grain boundaries disappear by forming a solid solution during carburization, and the pinning (restraint) by such precipitate particles p is broken (comes undone), and some adjacent pairs of crystal grains thus made free from the pinning at the grain boundaries coalesce and grow into one crystal grain.

Crystal grains which have increased in size in such a manner can gain power for grain growth, and under a relative reduction in the pinning force of precipitate particles p, each crystal grain breaks the pinning of grain boundaries by the precipitate particles p and swallows one neighboring crystal grain after another, thereby continuing the grain growth.

That is, once the grain boundary pinning by precipitate particles p has been broken, the pinning-broken crystal grain boundaries function as the center of grain growth, and from such grain boundaries, the grain growth of the crystal grain occurs chain-reactionally to develop into abnormal grain growth and finally abnormally form giant crystal grains Q as shown in (b) of FIG. 1(B).

(c) of FIG. 1(B) shows an example of abnormally-grown grains (a photograph of crystal grains after carburization).

Incidentally, the photograph of this example is a photograph of the central portion of a steel material listed as Comparative Example 1 in Table 1 in the case where the steel material has been subjected to a carburizing treatment at 1,100° C.

When such abnormal grain growth occurs, heat treatment distortion develops due to local improvement of hardenability and thus causes problems of making noises and vibrations or reducing the fatigue strength.

Conventionally, in such a case, measures have been taken so that greater precipitate particles are precipitated in a dispersed state to further improve the power of grain boundary pinning by the precipitate particles. However, occurrence of the abnormal grain growth cannot be sufficiently prevented by such measures.

Particularly in recent years, the use of a technique of raising carburization temperatures to reduce the carburizing time, a technique of performing cold forging for reduction of manufacturing costs of parts and techniques adaptable to environmental protection such as vacuum carburization performed to reduce emissions of $CO_2$ in the middle of manufacturing and to improve the strength have been widespread. However, the abnormal grain growth has been more likely to occur under these techniques. Accordingly, there have been demands for measures allowing for effective inhibition of such abnormal grain growth.

In addition, as another background art relating to the present invention, an invention of "a case hardening steel excellent in cold workability and crystal grain coarsening properties" has been disclosed in Patent Document 3 below, and this document discloses the point that, since AlN particles currently in use for pinning crystal grain boundaries are solid-solved or increased in size thereof in a region at a temperature of 900° C. or higher and thus are unable to have much effect on prevention of grain coarsening at the time of the carburizing treatment, the prevention of grain coarsening is attempted by adding Nb and Al to steel and causing these elements to be combined with C and N, thereby forming fine composite precipitates.

However, the invention disclosed in Patent Document 3 is basically different from the present invention in a point that an excessive amount of Nb is added in contrast to the present invention in which the addition of Nb is avoided as an impurity.

As still another background art relating to the present invention, an invention of "a case hardening steel excellent in crystal grain-coarsening resisting properties, fatigue properties and machinability, and a manufacturing method thereof" has been disclosed in Patent Document 4 below, and this document has discloses the point that, without impairing the crystal grain-coarsening resisting properties, fatigue properties and machinability are improved by properly adjusting the grain size distribution of Ti precipitates in the steel.

However, the substance of the disclosure made in Patent Document 4 consists of precipitating 10 pieces/$mm^2$ or more of Ti precipitates having a size of 1.0 μm to 5.0 μm and all the steels 1 to 26 according to the invention disclosed in Patent Document 4 include an excessive amount of Ti as compared to an amount of N and do not fall within the scope of the expression (1) in the present invention. The invention disclosed in Patent Document 4 is therefore different from the present invention.

As still another background art relating to the present invention, an invention of "a steel for carburized parts which is excellent in cold workability, allows prevention of crystal grains from coarsening at the time of carburization and has excellent impact-resisting properties and impact fatigue-resisting properties" has been disclosed in Patent Document 5 below, and this document discloses the point that Ti or both Ti and Nb are added to steel in such amounts as not to impair cold workability and machinability and allow to be precipitated in the form of carbides or nitrides thereof, thereby allowing prevention of crystal grain coarsening at the time of the carburization.

Claim 1 of Patent Document 5 discloses that the Ti content is limited to 0.1% to 0.2%, the N content is limited to 0.01% or less, and the Al content is limited to 0.005% to 0.05%. However, in Examples 1 to 11 actually disclosed therein, an excessive amount of Ti is added as compared to an amount of N, in terms of molar ratio, for precipitating TiC. The concept of this disclosure is therefore opposite to that of the present invention and outside the scope of expression (1) in the present invention.

In addition, in Claim 2 of Patent Document 5, the Ti content is limited to 0.025% to 0.05%, the Nb content is limited to 0.03% to 0.2%, the N content is limited to 0.01% or less, and the Al content is limited to 0.005% to 0.05%. Therefore, it is different from the present invention in that an excessive amount of Nb is added.

BACKGROUND ART DOCUMENT

Patent Document

Patent Document 1: JP-A-2001-303174

Patent Document 2: JP-A-08-199303

Patent Document 3: JP-A-09-78184

Patent Document 4: JP-A-2007-31787

Patent Document 5: JP-A-2006-213951

SUMMARY OF THE INVENTION

Problems that the Invention is to Solve

The present invention has been made under the above circumstance as a background, and an object thereof is to provide a carburized part which allows for effective inhibition of abnormal grain growth in spite of a carburizing treatment and makes it possible to solve the problem of reduction in properties caused by abnormal grain growth.

Means for Solving the Problems

The present invention relates to the following [1] to [4].

[1] A carburized part having a total amount of TiC, AlN and ZrC, which are precipitate particles, of $4.5\times10^{-10}$ mole or less per 1 $mm^2$ of grain boundary area of prior austenite grains after carburization.

[2] The carburized part according to [1], in which a structure thereof after the carburization is a well-ordered grain structure having a uniform crystal grain size in which a crystal grain size difference of the prior austenite grains is 6 or less.

[3] The carburized part according to [1] or [2], which is formed by processing a steel material into a shape of a part and performing a carburizing treatment on the steel material, the steel material having a composition consisting essentially of, in terms of % by mass:
0.10% to 0.30% of C;
0.01% to 1.50% of Si;
0.40% to 1.50% of Mn;
0.01% to 0.10% of S;
0.03% or less of P;
0.05% to 1.00% of Cu;
0.05% to 1.00% of Ni;
0.01% to 2.00% of Cr;
0.01% to 0.50% of Mo;
0.001% or less of Nb;
0.005% to 0.050%, of s-Al;
0.005% to 0.030% of N; and
one or two elements selected from 0.001% to 0.150% of Ti and 0.001% to 0.300% of Zr, and optionally: 0.001% to 0.010% of B, with the remainder being Fe and inevitable impurities,
in which [Ti], [Zr] and [N] which respectively represent contents of Ti, Zr and N satisfy the following equation (1):

$$|[Ti]/47.9+[Zr]/91.2-[N]/14|/100\leq3.5\times10^{-6}\ \text{mole/g} \qquad \text{Equation (1).}$$

[4] The carburized part according to [1] or [2], which is formed by processing a steel material into a shape of a part and performing a carburizing treatment on the steel material, the steel material having a composition consisting essentially of, in terms of % by mass:
0.10% to 0.30% of C;
0.01% to 1.50% of Si;
0.40% to 1.50% of Mn;
0.01% to 0.10% of S;
0.03% or less of P;
0.05% to 1.00% of Cu;
0.05% to 1.00% of Ni;
0.01% to 2.00% of Cr;
0.01% to 0.50% of Mo;
0.001% or less of Nb;
0.001% to 0.008% of s-Al;
less than 0.001% of Ti;
less than 0.001% of Zr; and
0.005% to 0.030% of N,
and optionally:
0.001% to 0.010% of B,
with the remainder being Fe and inevitable impurities.

Advantage of the Invention

According to the present invention, it is possible to provide a carburized part which allows for effective inhibition of abnormal grain growth in spite of a carburizing treatment and makes it possible to solve the problem of reduction in properties caused by abnormal grain growth.

MODE FOR CARRYING OUT THE INVENTION

The present invention aiming to prevent abnormal grain growth does not follow the technique of the conventional art of intensifying restraint, that is, pinning, of crystal grain boundaries by precipitating a large number of particles having a pinning action (precipitate particles) in a dispersed state, but the present invention adopts a technical idea opposite to that of the conventional art. The present invention adopts a technical idea of minimizing the number of precipitate particles, that is, minimizing the grain boundary pinning by precipitate particles.

Specifically, the density of precipitate particles is minimized by limiting a total amount of TiC, AlN and ZrC, which are precipitate particles, to $4.5\times10^{-10}$ mole or less per 1 $mm^2$ of grain boundary area of prior austenite grains after carburization (the above-mentioned [1]).

In a traditional common-sense manner of thinking, it is considered that when the number of precipitate particles is minimized or zero in the extreme case, crystal grains can grow without restraints, whereby the crystal grains become coarse.

In fact, each of the techniques of the background art for preventing grain growth is a principle to carry out the pinning of crystal grain boundaries by precipitating precipitate particles.

Under the circumstances, the idea of the present invention of preventing crystal grains from becoming coarse by minimizing precipitation of precipitate particles so as not to cause pinning of crystal grain boundaries is a unique view directly contrary to common sense in view of the background art.

In other words, in the background art, the condition that the pinning force of precipitate particles is greater than the driving force for crystal grain growth is created in the initial stage of carburization. On the other hand, the present invention is characterized in that the condition that the driving force for crystal grain growth is greater than the pinning force of precipitate particles is created even in the initial stage of carburization.

Hereinafter, this point will be described based on the model diagram of FIG. 1(A).

Figure 1A:
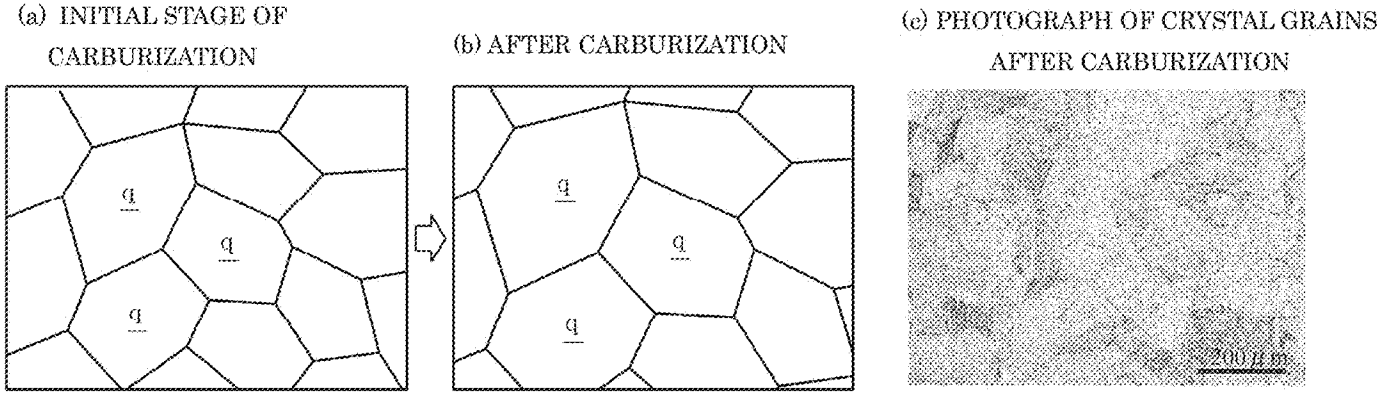
FIG. 1(A) is a model diagram shown for illustrating the principle of the present invention.
Figure 1B:
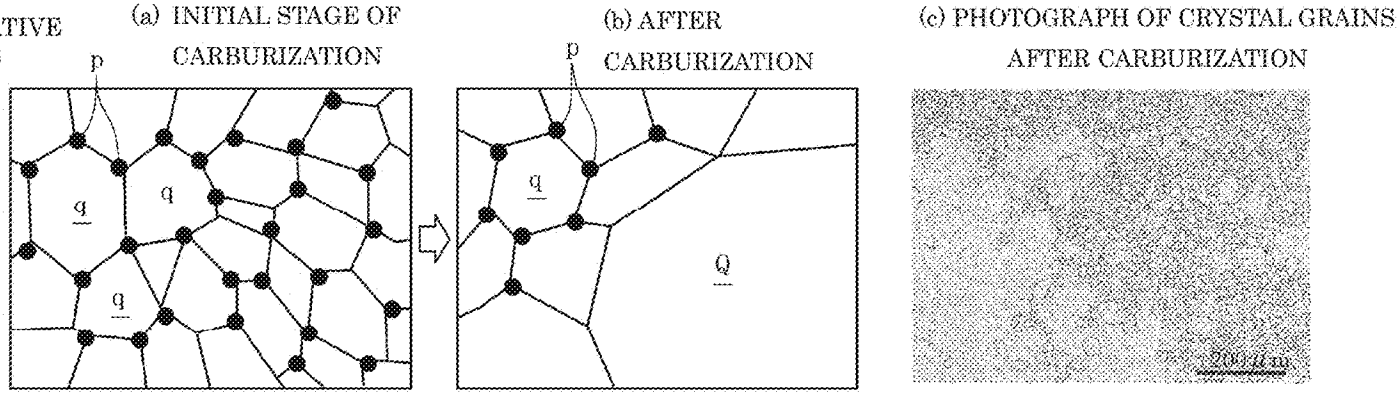
FIG. 1(B) is a comparative example diagram shown for illustrating formation of abnormal grain growth.

In the model diagram of FIG. 1(A) (which is, for convenience of understanding, presented on the assumption that there is no precipitation of precipitate particles), individual crystal grains q are almost the same in size and are in contact with one another along the respective crystal grain boundaries in the initial stage of carburization of (a).

Thereafter, in the technique of pinning crystal grain boundaries by precipitate particles in the background art, as described above, some of the precipitate particles are solid-solved to disappear during the carburization, and thus the abnormal grain growth occurs in which a certain crystal grain continues to exceptionally grow so as to become coarse, whereby the giant grain is formed.

In contrast to such a result, in the case of model diagram of FIG. 1(A) according to the present invention, since there is no restraint, or no pinning, of crystal grain boundaries by precipitate particles from the beginning of carburization, there is a tendency for crystal grains q to freely grow without undergoing the pinning action of precipitate particles during the carburization.

However, all the crystal grains q are the same in a point of having a tendency to freely grow without undergoing the pinning action of precipitate particles. As a result, each crystal grain q receives grain growth pressure of other crystal grains around itself as pressure for inhibition of grain growth. As a result, it is not possible for any of crystal grains q to grow exceptionally and all crystal grains q are confined to growth equally to some extent.

As a result, despite the absence of precipitate particles to stop the grain growth (if anything, for just the reason why such precipitate particles are absent), individual crystal grains q are confined to slight growth to the same extent as one another, and it becomes possible to effectively inhibit the abnormal growth of any specific crystal grain among the crystal grains q from occurring exceptionally.

Incidentally, (c) of FIG. 1(A) shows a photograph of a sample in which abnormal grain growth has been inhibited by minimizing precipitation of precipitate particles (a photograph of crystal grains after carburization).

In addition, the photograph of such a sample is a photograph of the central portion of a steel material listed as Example 1 in Table 1 in the case where the steel material has been subjected to a carburizing treatment at 1,100° C.

According to the studies by the present inventors, it has been found that the prevention of abnormal grain growth as mentioned above can be achieved by minimizing the density of precipitate particles in steel through the reduction in a total amount of TiC, AlN and ZrC, which are precipitate particles, to $4.5\times10^{-10}$ mole or less per 1 $mm^2$ of the grain boundary area of prior austenite grains after carburization.

As is made clear from the results of Examples to be described later, it is possible to inhibit the abnormal grain growth by minimizing the amounts of precipitate particles as described above, whereby variations in the sizes of individual crystal grains can be made small and any of the crystal grains can be prevented from exceptionally growing into giant grains.

Particularly, when the amount of precipitate particles is limited to a predetermined value or less according to the above-mentioned [1], it is possible to obtain, as a structure after the carburizing treatment, a well-ordered grain structure having a uniform crystal grain size such that the crystal grain size difference is 6 or less (the above-mentioned [2]).

Further, the above-mentioned [1] allows hardenability to be equalized, and thus it is possible to improve the properties of carburized parts, such as control of heat treatment distortion to a small value and effective improvement of fatigue strength.

The term "crystal grain size difference" used herein refers to a difference between the highest grain size number and the lowest grain size number corresponding to cross-sectional areas of individual crystal grains whose photograph has been taken for size measurements.

The crystal grain size difference can be obtained as follows.

A photograph of the crystal grains in a measurement range of 3 mm×3 mm is taken, and cross-sectional areas of the individual crystal grains are measured. Next, grain size numbers corresponding to the cross-sectional areas are obtained based on Table 1 of JIS G 0551 (1998).

For example, in the case where the cross-sectional area is 0.060 $mm^2$, the grain size number is defined as No. 1 from a cross-sectional area of 0.0625 $mm^2$ described directly above in the table. A difference between the highest grain size number and the lowest grain size number determined in such a manner is referred to as a grain size number difference.

Incidentally, the contents of JIS G 0551 (1998) are incorporated herein by reference.

In the present invention, the reasons for limiting the total amount of TiC, AlN and ZrC, which are precipitate particles, per unit area of 1 $mm^2$ of the grain boundary area of prior austenite grains are as follows.

First, the pinning effect by precipitate particles varies depending on the grain boundary area and as the grain boundary area increases, a large number of precipitate particles are required. In contrast, as the grain boundary area decreases, the number of precipitate particles may become smaller.

Second, the amount of precipitate particles is merely an amount of precipitate particles measured in a carburized part, and the amount of precipitate particles includes precipitate particles present at prior austenite grain boundaries and precipitate particles absent at prior austenite grain boundaries. Here, as the amount of precipitation increases, the amount of precipitate particles present at grain boundaries also naturally increases.

Third, the amount of precipitate particles at grain boundaries is important in the present invention. However, when the total amount of precipitate particles is large, the amount of precipitate particles present at grain boundaries also increases and thus the total amount of precipitate particles is converted and arranged into an amount per unit area of prior austenite grains, whereby an effect on pinning by precipitate particles can be determined.

In the present invention, a carburized part according to the above-mentioned [1] or [2] can be obtained using a steel having the chemical composition defined in the above-mentioned [3].

In this case, the density of precipitate particles acting on the pinning of crystal grain boundaries can be minimized by controlling the contents of Ti, Zr and N so as to satisfy the above expression (1).

Specifically, by adding one or two elements selected from Ti and Zr to the steel, at least one element selected from Ti and Zr combines with N included in the steel at the time of forging of the steel, and crystallizes in the form of at least one of TiN and ZrN having no contribution to the pinning of crystal grain boundaries. By carrying out such addition, it is possible to prevent AlN having a pinning action from being precipitated through the combination of N in the steel with Al.

However, when excessive amount of Ti and/or Zr is added, precipitation of TiC and/or ZrC is caused to result in the formation of precipitate particles having a pinning action, and thus it is important to control amounts of these elements so as not to be excessive and so as to satisfy the expression (1).

In short, the expression (1) has the following meaning.

That is, in either of two cases of a case where a large amount of N convertible into AlN by the reaction with Al in steel is present in the steel and a case where large amounts of Ti and Zr convertible into TiC and ZrC by the reaction with C in steel are present, undesirable amounts of precipitate particles are formed in steel. Therefore, at least one element selected from Ti and Zr is made to crystallize with N in steel into crystallized products at the time of solidification, whereby at least one element selected from N, Ti and Zr which are capable of forming precipitate particles are fixed (consumed), and hence it follows that redundant Ti, Zr and N are defined by the expression (1) and the value thereof is controlled to a target value of $3.5\times10^{-6}$ mole/g or less.

However, it is also possible to minimize the density of precipitate particles acting on pinning of crystal grain boundaries by adopting the chemical composition defined in the above-mentioned [4] into a steel material used for carburized parts.

Specifically, in the above-mentioned [4], with the addition of Ti and Zr for consuming N in steel by forming crystallized products in an amount of less than 0.001%, preferably, with no addition of Ti and Zr, the added amount of s-Al which forms precipitate particles is made minute, and thus the density of precipitate particles is minimized.

In addition, in the present invention, the steel can includes, in terms of % by mass, B: 0.001% to 0.010% as an optional component [the above-mentioned [5]].

In the present invention, the grain boundary area of prior austenite grains and the amounts of TiC, AlN and ZrC precipitated can be obtained as follows.

(Method for Obtaining Grain Boundary Area)

The surface of a carburized product is vertically cut and a sample for observation is cut out from the carburized product. The section including the surface is polished to make prior austenite grain boundaries appear. Then, an average crystal grain size n is measured according to the method defined in JIS G 0551 (1998) (when the average crystal grain size is measured, measurement may be performed including the surface (carburized layer)). Thus, a prior austenite grain radius r is calculated by the following expression.

$$r=(3/2\times1/(2^{(n+3)}\times\pi))^{0.5} \quad \text{Expression (2)}$$

In addition, the expression (2) is obtained as follows.

A relationship between the number of crystal grains m per unit area (1 $mm^2$) in JIS G 0551 and the average crystal grain size n satisfies $m=2^{(n+3)}$. From this relational expression, on the assumption that prior austenite grains has a spherical shape having a radius r, the sectional area of the crystal grains is $\pi r^2=3/2\times1/m=3/2\times1/(2^{(n+3)})$. Thus, the radius r can be expressed by the expression (2).

Here, the coefficient of "3/2" is a coefficient which is determined in consideration that the measured section is generally shifted from the center of the crystal grain.

The grain boundary area can be expressed by the following expression (3) using the radius r.

$$\text{Grain boundary area}=(\text{number of prior austenite grains included in unit mass (1 g) of steel material})\times\text{surface area of one prior austenite grain}\times 1/2=(1000/7.8)/(4/3\times\pi\times r)\times4\pi r^2\times1/2 \quad \text{Expression (3)}$$

Here, "(1000/7.8)" is a reciprocal of the density of the steel and "1/2" is a coefficient which is determined in consideration that neighboring crystal grains are in contact with one another.

Accordingly, by the above expressions (2) and (3), the grain boundary area of prior austenite can be obtained by measuring the average crystal grain size n.

(Quantitation Method of TiC)

Extraction of all precipitates is performed according to an electrolytic method using a methanol solution containing 10% acetyl acetone and 1% tetramethylammonium chloride (10% AA solution). After electrolysis, suction filtration is performed using a Nuclepore Filter with a pore size of 0.2

μm, and a portion of the residue obtained is changed to a solution by fusion based on a mixed acid decomposition, and then metallic element components in all the precipitates are quantitated by ICP optical emission spectroscopy, thereby determining an amount of Ti precipitates per predetermined mass and further converting the amount into an amount per unit gram. Another portion of the residue obtained is subjected to an immersion treatment in a methanol solution containing 10% bromine, thereby extracting only TiN as a residue and converting the amount of the residue into an amount per unit gram by mass measurement. And the amount of TiC (amount of TiC per unit gram) is determined from the following expression:

Amount of TiC=(amount of all Ti precipitates)−(amount of TiN).

(Quantitation Method of ZrC)

Quantitation of ZrC is made using the same method as in the quantitation of TiC.

(Quantitation Method of AlN)

A portion of the residue left after dissolving a matrix in a methanol solution containing 14% iodine is subjected to quantitation of total Al (AlN and $Al_2O_3$) per unit gram according to ICP optical emission spectroscopy. In addition, when another portion of the residue is subjected to acid decomposition using sulfuric acid, whereby the nitride and the oxide are separated, the oxide is left in the residue. The Al quantitation by elemental analysis can be translated into $Al_2O_3$ quantitation. Accordingly, the amount of AlN can be determined from the following expression:

Amount of AlN=total amount of Al components (AlN and $Al_2O_3$)−amount of $Al_2O_3$.

From the grain boundary area and the amount of precipitates determined by the above method, the amount of precipitates per 1 $mm^2$ of prior austenite grain boundary can be obtained by the following expression:

Amount of precipitates per 1 $mm^2$ of prior austenite grain boundary=(amount of precipitates)/(area of prior austenite grain boundary)

The reasons for limiting individual chemical components and the like in the present invention will be described below.

C: 0.10% to 0.30%

C is contained in an amount of 0.10% or more from the viewpoint of ensuring hardness and strength. However, when C is contained in an excessive amount of more than 0.30%, workability is deteriorated when a steel material is processed into a shape of a part like gears by machining such as hot forging or cold forging and cutting. Thus, the upper limit of the C content is 0.30%.

The C content is preferably 0.15% to 0.25%.

Si: 0.01% to 1.50%

It is necessary that Si is contained in an amount of 0.01% or more from the viewpoint of ensuring machinability. However, when Si is contained in an excessive amount of more than 1.50%, forgeability and machinability are deteriorated and thus the upper limit of the Si content is 1.50%.

The Si content is preferably 0.10% to 1.3% and more preferably 0.20% to 1.0%.

Mn: 0.40% to 1.50%

Mn is contained in an amount of 0.40% or more from the viewpoint of controlling the shape of inclusions such as MnS and ensuring hardenability. In addition, when Mn is contained in an amount of lower than 0.40%, Mn induces formation of ferrite at the core, whereby strength is decreased. Thus, in this sense, Mn is contained in an amount of 0.40% or more. However, when Mn is contained in an excessive amount of more than 1.50%, machinability is deteriorated. Therefore, the upper limit of the Mn content is 1.50%.

The Mn content is preferably 0.50% to 1.3% and more preferably 0.7% to 1.0%.

S: 0.01% to 0.10%

S is contained in an amount of 0.01% or more from the viewpoint of ensuring machinability. However, when S is contained in an excessive amount of more than 0.10%, strength is decreased. Thus, the upper limit of the S content is 0.10%.

The S content is preferably 0.03% to 0.07%.

P: 0.03% or Less

In the present invention, P is an impurity component which causes reduction in strength, and the P content is limited to 0.03% or less. The P content is preferably 0.025% or less and more preferably 0.02% or less.

Cu: 0.05% to 1.00%

Cu is effective for ensuring hardenability when the content thereof is 0.05% or more. On the other hand, when Cu is contained in an excessive amount of more than 1.00%, hot workability is deteriorated. Thus, the upper limit of the Cu content is 1.00%.

The Cu content is preferably 0.20% to 0.70% and more preferably 0.10% to 0.50%.

Ni: 0.05% to 1.00%

Ni is effective for ensuring hardenability when the content thereof is 0.05% or more. On the other hand, when Ni is contained in an excessive amount of more than 1.00%, the amount of carbide precipitates is reduced, whereby lowering of strength is caused. Thus, the upper limit the Ni content is 1.00%.

The Ni content is preferably 0.10% to 0.70% and more preferably 0.20% to 0.50%.

Cr: 0.01% to 2.00%

Cr is an element effective for improving hardenability and improving strength and is therefore contained in an amount of 0.01% or more. However, when Cr is contained in an excessive amount of more than 2.00%, workability, particularly, machinability is deteriorated. Thus, the upper limit of the Cr content is 2.00%.

The Cr content is preferably 0.30 to 1.50% and more preferably 0.50% to 1.00%.

Mo: 0.01% to 0.50%

Mo is an element which improves strength, and is therefore contained in an amount of 0.01% or more. In the case where a greater effect on improvement of strength by the addition of Mo is desired, it is preferred that Mo is contained in an amount of 0.15% or more. However, when Mo is contained in an excessive amount of more than 0.50%, workability is deteriorated and costs also increase. Thus, the upper limit of the Mo content is 0.50%.

The Mo content is preferably 0.05% to 0.30% and more preferably 0.10% to 0.20%.

Nb: 0.001% or Less

In the present invention, Nb is an impurity element. When Nb is present, NbC precipitates and pins grain boundaries. Thus, the Nb content is controlled to 0.001% or less.

s-Al: 0.005% to 0.050% (the above-mentioned [3]) or 0.001% to 0.008% (the above-mentioned [4])

Al is incorporated into the steel for use as a deoxidizer. In the above-mentioned [3], the s-Al content is limited to be within a range of 0.005% to 0.050%.

On the other hand, in the above-mentioned [4], the upper limit of s-Al content is controlled to 0.008% or less in order to prevent formation of AlN, since Zr and Ti as components in the steel are contained in an amount of less than 0.001%, or Zr and Ti are preferably not substantially contained in the steel.

s-Al means acid soluble aluminium and can be quantitated by the method defined in JIS G 1257 (1994), Appendix 15. In addition, the contents of JIS G 1257 (1994) are incorporated herein by reference.

N: 0.005% to 0.030%

At least one selected from Ti: 0.001% to 0.150%/o and Zr: 0.001% to 0.300% (the above-mentioned [3])

Ti: <0.001% and Zr: <0.001% (the above-mentioned [4])

Each of these N, Ti and Zr minimizes the precipitation density of harmful precipitate particles by interactions with one another. The minimization conditions are within ranges satisfying the expression (1) in above-mentioned [3].

In addition, in the above-mentioned [4], respective contents are within ranges required for minimization of the precipitation density of harmful precipitate particles as described above.

Each of steel materials having chemical compositions shown in Table 1 was melted, kept for 4 hours under heating at 1,250° C., and then subjected to hot rolling at a temperature of 950° C. or higher, thereby being formed into a steel bar having a diameter φ of 30 mm.

Figure 2A:
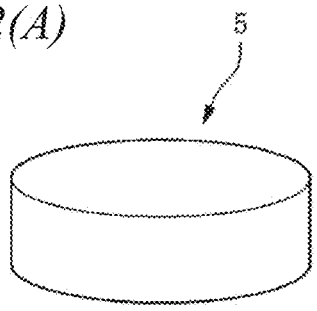
FIGS. 2(A)-2(D) are diagrams showing test pieces used in crystal grain size measurement and rotation bending fatigue test.

A coin-shaped test piece 5 having a size of φ 20 mm×6 mm as shown in FIG. 2(A) was prepared from each of the steel bars.

Then, this test piece 5 was subjected to gas carburizing and quenching under the following conditions. Specifically, propane was used as a carburizing gas, the test piece 5 was made to retain CP (carbon potential) of 0.8% at 1,100° C. for 3 hours, and thereafter the test piece further made to retain CP of 0.8% at 850° C. for 0.5 hours, and then subjected to quenching in oil of 80° C.

Then, the test piece was kept at 550° C. for 16 hours so that prior austenite grain boundaries were likely to appear, and subsequently underwent air-cooling.

TABLE 1

| | | Chemical composition (% by mass) | | | | | | | | | | | | | | | |
|---|---|---|---|---|---|---|---|---|---|---|---|---|---|---|---|---|---|
| | | C | Si | Mn | P | S | Cu | Ni | Cr | Mo | s-Al | Ti | Nb | Zr | T-N | B | Expression (1) |
| Example | 1 | 0.14 | 0.69 | 0.85 | 0.00 | 0.09 | 0.34 | 0.55 | 1.65 | 0.34 | 0.029 | 0.0256 | ≤0.001 | <0.001 | 0.0075 | — | $1.3 \times 10^{-8}$ |
| | 2 | 0.18 | 0.15 | 1.39 | 0.01 | 0.02 | 0.05 | 0.05 | 1.12 | 0.01 | 0.022 | 0.0234 | ≤0.001 | <0.001 | 0.0077 | — | $6.1 \times 10^{-7}$ |
| | 3 | 0.18 | 0.49 | 1.28 | 0.00 | 0.03 | 0.85 | 0.77 | 1.39 | 0.43 | 0.043 | 0.0703 | ≤0.001 | <0.001 | 0.0254 | — | $3.5 \times 10^{-6}$ |
| | 4 | 0.26 | 0.71 | 1.16 | 0.02 | 0.07 | 0.10 | 0.55 | 1.90 | 0.19 | 0.017 | 0.0895 | ≤0.001 | <0.001 | 0.0213 | 0.005 | $3.5 \times 10^{-6}$ |
| | 5 | 0.24 | 0.28 | 1.34 | 0.03 | 0.10 | 0.36 | 0.48 | 0.10 | 0.36 | 0.025 | 0.0849 | ≤0.001 | <0.001 | 0.0242 | 0.005 | $4.4 \times 10^{-7}$ |
| | 6 | 0.19 | 1.07 | 0.84 | 0.01 | 0.05 | 0.92 | 0.30 | 1.43 | 0.30 | 0.008 | <0.001 | ≤0.001 | <0.001 | 0.0280 | — | — |
| | 7 | 0.18 | 1.29 | 0.54 | 0.00 | 0.05 | 0.60 | 0.61 | 1.65 | 0.45 | 0.001 | <0.001 | ≤0.001 | <0.001 | 0.0050 | — | — |
| | 8 | 0.29 | 1.25 | 1.23 | 0.03 | 0.02 | 0.42 | 0.92 | 0.03 | 0.42 | 0.008 | 0.0176 | ≤0.001 | <0.001 | 0.0062 | — | $7.5 \times 10^{-7}$ |
| | 9 | 0.21 | 0.49 | 0.65 | 0.03 | 0.05 | 0.15 | 0.92 | 0.72 | 0.39 | 0.007 | 0.1040 | ≤0.001 | <0.001 | 0.0290 | — | $1.0 \times 10^{-6}$ |
| | 10 | 0.28 | 1.43 | 0.77 | 0.00 | 0.07 | 0.42 | 0.44 | 0.25 | 0.02 | 0.031 | 0.0076 | ≤0.001 | 0.04 | 0.0122 | — | $2.7 \times 10^{-6}$ |
| | 11 | 0.27 | 0.59 | 0.62 | 0.01 | 0.08 | 0.48 | 0.60 | 0.61 | 0.06 | 0.014 | 0.0031 | ≤0.001 | 0.13 | 0.0244 | — | $2.5 \times 10^{-6}$ |
| | 12 | 0.20 | 0.19 | 0.79 | 0.01 | 0.02 | 0.07 | 0.07 | 1.21 | 0.12 | 0.001 | <0.001 | ≤0.001 | <0.001 | 0.0050 | 0.009 | — |
| | 13 | 0.23 | 0.82 | 0.54 | 0.01 | 0.02 | 0.10 | 0.08 | 0.95 | 0.08 | 0.015 | <0.001 | ≤0.001 | 0.05 | 0.0110 | — | $2.4 \times 10^{-6}$ |
| Comparative Example | 1 | 0.21 | 0.74 | 0.69 | 0.03 | 0.05 | 0.09 | 0.71 | 1.81 | 0.26 | 0.038 | 0.003 | ≤0.001 | <0.001 | 0.016 | — | $1.1 \times 10^{-5}$ |
| | 2 | 0.24 | 1.42 | 1.33 | 0.02 | 0.05 | 0.51 | 0.42 | 0.05 | 0.39 | 0.016 | 0.01 | ≤0.001 | <0.001 | 0.017 | 0.005 | $1.0 \times 10^{-5}$ |
| | 3 | 0.28 | 0.26 | 0.62 | 0.01 | 0.09 | 0.40 | 0.43 | 0.89 | 0.22 | 0.054 | 0.011 | ≤0.001 | <0.001 | 0.03 | — | $1.9 \times 10^{-5}$ |
| | 4 | 0.18 | 0.54 | 1.09 | 0.01 | 0.08 | 0.65 | 0.29 | 0.95 | 0.02 | 0.038 | 0.118 | ≤0.001 | <0.001 | 0.026 | — | $6.1 \times 10^{-6}$ |
| | 5 | 0.17 | 0.50 | 1.32 | 0.01 | 0.04 | 0.97 | 0.81 | 1.18 | 0.11 | 0.013 | 0.076 | ≤0.001 | <0.001 | 0.015 | — | $5.0 \times 10^{-6}$ |
| | 6 | 0.24 | 1.21 | 1.36 | 0.01 | 0.03 | 0.28 | 0.55 | 0.95 | 0.03 | 0.026 | 0.135 | ≤0.001 | <0.001 | 0.024 | — | $1.1 \times 10^{-5}$ |
| | 7 | 0.15 | 0.96 | 0.80 | 0.02 | 0.01 | 0.56 | 0.58 | 1.13 | 0.46 | 0.028 | 0.160 | ≤0.001 | <0.001 | 0.01 | — | $3.0 \times 10^{-5}$ |
| | 8 | 0.26 | 0.22 | 0.85 | 0.01 | 0.10 | 0.95 | 0.56 | 1.24 | 0.30 | 0.019 | 0.001 | 0.045 | <0.001 | 0.022 | — | $1.5 \times 10^{-5}$ |
| | 9 | 0.20 | 1.29 | 0.67 | 0.02 | 0.02 | 0.70 | 0.47 | 0.29 | 0.33 | 0.019 | 0.088 | ≤0.001 | 0.08 | 0.010 | — | $2.0 \times 10^{-5}$ |
| | 10 | 0.19 | 1.29 | 1.32 | 0.02 | 0.07 | 0.66 | 0.32 | 1.71 | 0.15 | 0.027 | 0.10 | ≤0.001 | 0.08 | 0.006 | — | $2.4 \times 10^{-5}$ |
| | 11 | 0.19 | 1.39 | 0.44 | 0.03 | 0.07 | 0.98 | 0.74 | 0.39 | 0.01 | 0.049 | 0.028 | ≤0.001 | 0.33 | 0.02 | — | $3.0 \times 10^{-5}$ |

B: 0.001% to 0.010%

B is an element which improves hardenability and 0.001% or more of B can be contained as required. However, when the content thereof is more than 0.010%, precipitates of B are formed at grain boundaries to reduce strength.

Total Amount of TiC, AlN and ZrC which are Precipitate Particles: $4.5\times10^{-10}$ Mole or Less A total amount of TiC, AlN, and ZrC, which are precipitate particles, is $4.5\times10^{-10}$ mole or less per 1 $mm^2$ of grain boundary area of prior austenite grains in a part after carburization. This is important because the formation of precipitate particles from the initial stage of carburization is minimized, thereby preventing grain boundaries from being substantially restrained by pinning by the precipitate particles or weakening the pinning force.

EXAMPLES

Examples according to the present invention will be described below in details.

The "T-N" represents a total amount of nitrogen.

Figure 2B:
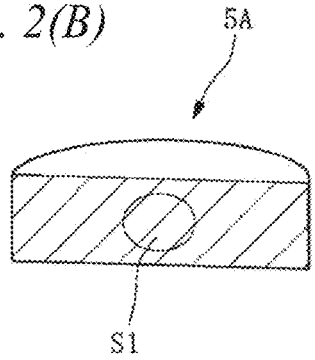

After the heat treatment, the test piece was cut in half (refer to FIG. 2(B)), and the section thereof was mirror-polished. Further, the polished section was etched with a saturated picric acid solution, whereby prior austenite grain boundaries appeared. Then, an average crystal grain size was measured according to the method defined in JIS G 0551 (1998). Incidentally, the measurement spot may include the surface layer. However, the central portion represented by S1 in the drawing was chosen as a measurement spot.

Further, a crystal grain size difference was determined by the method mentioned above.

On the other hand, similar to the coin-shaped test pieces, using each sample for analysis cut out from the steel bars, the amounts (mole) of TiC, AlN and ZrC which are precipitate particles contained in the steel materials were quantitated by the above-mentioned methods and converted into amounts per 100 g of steel material. Further, the grain boundary area ($mm^2$) of prior austenite grains per 1 g of steel material obtained from the measured average crystal grain size n was converted into an area per 100 g of steel material. Thus, an amount of precipitate particles per 1 $mm^2$ of grain boundary area of prior austenite grains was calculated from these values.

The results are shown together in Table 2.

whereby prior austenite grain boundaries appeared. The section was observed with an optical microscope and whether abnormal grain growth was present or not was observed. In addition, the observed spot was a notch bottom portion represented by S2 in FIG. 2 (D).

The results are shown together in Table 2.

TABLE 2

| | | Amount of precipitate (mole) | | | | Average crystal grain | Crystal grain size | Amount of precipitate per 1 $mm^2$ of grain boundary | Presence or absence of | Fatigue strength |
|---|---|---|---|---|---|---|---|---|---|---|
| | | TiC | AlN | ZrC | Total | size (n) | difference | (mole/$mm^2$) | coarse grain | (MPa) |
| Example | 1 | $3.5 \times 10^{-6}$ | — | — | $3.5 \times 10^{-6}$ | 7.7 | 5 | $3.1 \times 10^{-12}$ | ○ | 624 |
| | 2 | — | $5.7 \times 10^{-7}$ | — | $5.7 \times 10^{-7}$ | 6.5 | 4 | $7.6 \times 10^{-13}$ | ○ | 623 |
| | 3 | — | $3.3 \times 10^{-4}$ | — | $3.3 \times 10^{-4}$ | 8.0 | 4 | $2.6 \times 10^{-10}$ | ○ | 629 |
| | 4 | $2.9 \times 10^{-4}$ | — | — | $2.9 \times 10^{-4}$ | 6.8 | 5 | $3.4 \times 10^{-10}$ | ○ | 626 |
| | 5 | $4.5 \times 10^{-5}$ | — | — | $4.5 \times 10^{-5}$ | 7.5 | 5 | $4.2 \times 10^{-11}$ | ○ | 621 |
| | 6 | — | $2.7 \times 10^{-4}$ | | $2.7 \times 10^{-4}$ | 6.1 | 5 | $4.1 \times 10^{-10}$ | ○ | 625 |
| | 7 | — | — | — | 0 | 4.5 | 6 | 0 | ○ | 628 |
| | 8 | — | $7.0 \times 10^{-5}$ | — | $7.0 \times 10^{-5}$ | 7.8 | 4 | $6.0 \times 10^{-11}$ | ○ | 621 |
| | 9 | $9.6 \times 10^{-5}$ | — | — | $9.6 \times 10^{-5}$ | 6.6 | 4 | $1.2 \times 10^{-10}$ | ○ | 625 |
| | 10 | — | $3.1 \times 10^{-4}$ | — | $3.1 \times 10^{-4}$ | 7.4 | 6 | $3.0 \times 10^{-10}$ | ○ | 627 |
| | 11 | — | — | $2.5 \times 10^{-6}$ | $2.5 \times 10^{-6}$ | 7.0 | 6 | $2.8 \times 10^{-12}$ | ○ | 629 |
| | 12 | — | — | — | 0 | 4.8 | 5 | 0 | ○ | 623 |
| | 13 | — | $1.2 \times 10^{-4}$ | — | $1.2 \times 10^{-4}$ | 5.9 | 5 | $2.0 \times 10^{-10}$ | ○ | 625 |
| Comparative Example | 1 | — | $1.0 \times 10^{-3}$ | — | $1.0 \times 10^{-3}$ | 8.7 | 8 | $6.5 \times 10^{-10}$ | X | 481 |
| | 2 | — | $8.0 \times 10^{-4}$ | — | $8.0 \times 10^{-4}$ | 8.9 | 9 | $4.6 \times 10^{-10}$ | X | 499 |
| | 3 | — | $1.6 \times 10^{-3}$ | — | $1.6 \times 10^{-3}$ | 5.4 | 9 | $3.1 \times 10^{-9}$ | X | 481 |
| | 4 | $6.0 \times 10^{-4}$ | — | — | $6.0 \times 10^{-4}$ | 3.5 | 9 | $2.3 \times 10^{-9}$ | X | 487 |
| | 5 | $4.2 \times 10^{-4}$ | — | — | $4.2 \times 10^{-4}$ | 3.8 | 9 | $1.4 \times 10^{-9}$ | X | 452 |
| | 6 | $1.0 \times 10^{-3}$ | — | — | $1.0 \times 10^{-3}$ | 8.5 | 9 | $6.9 \times 10^{-10}$ | X | 496 |
| | 7 | $2.7 \times 10^{-3}$ | — | — | $2.7 \times 10^{-3}$ | 9.9 | 10 | $1.1 \times 10^{-9}$ | X | 496 |
| | 8 | — | $4.1 \times 10^{-4}$ | — | $4.1 \times 10^{-4}$ | 6.8 | 10 | $4.9 \times 10^{-10}$ | X | 462 |
| | 9 | $4.4 \times 10^{-4}$ | $1.4 \times 10^{-3}$ | — | $1.8 \times 10^{-3}$ | 4.1 | 9 | $5.6 \times 10^{-9}$ | X | 493 |
| | 10 | $1.9 \times 10^{-3}$ | $5.4 \times 10^{-4}$ | — | $2.4 \times 10^{-3}$ | 9.4 | 7 | $1.1 \times 10^{-9}$ | X | 498 |
| | 11 | — | — | $2.8 \times 10^{-3}$ | $2.8 \times 10^{-3}$ | 1.6 | 8 | $2.1 \times 10^{-8}$ | X | 452 |

Figure 2C:
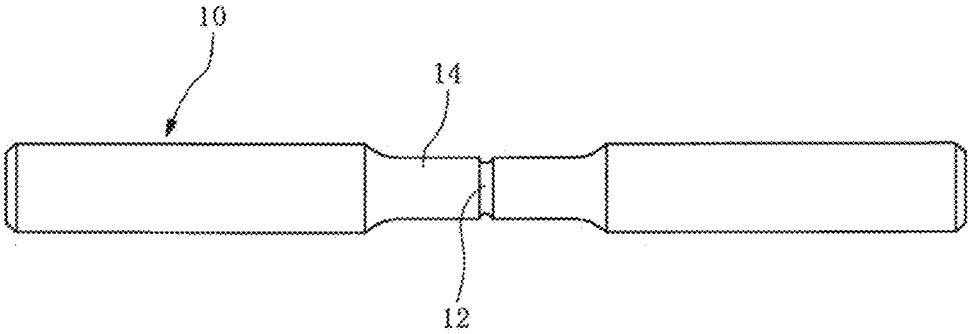
Figure 2D:
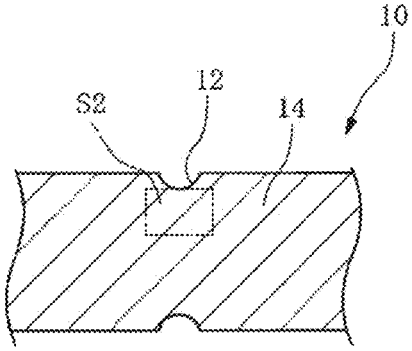

Here, in order to perform evaluation of fatigue strength of the carburized part, as shown in FIG. 2(C), an Ono-type rotation bending fatigue test piece 10 having a notch bottom 12 of 1R (radius: 1 mm) was prepared (diameter φ of parallel portion 14: 8 mm). This test piece 10 was kept at CP of 0.8% at 1,100° C. for 3 hours and thereafter the test piece further made to retain CP of 0.8% at 850° C. for 0.5 hours and then subjected to a carburization hardening treatment of quenching the test piece in oil of 80° C., as the same conditions described above. Then, the test piece was tempered at 180° C. for 1.5 hours and underwent air-cooling.

After the Ono-type rotation bending fatigue test piece 10 had undergone the carburization hardening and tempering treatments, an Ono-type rotation bending fatigue test was performed on the test piece 10 by the method according to JIS Z 2274 (1978). Each of the steel materials of Examples and Comparative Examples in Table 1 was examined for fatigue strength. In addition, the test was performed under conditions that the number of revolutions was 3,500 rpm and the test temperature was room temperature. Incidentally, the contents of JIS Z 2274 (1978) are incorporated herein by reference.

Each of values of fatigue strength in Table 2 is a numerical value representing the fatigue limit defined as the maximum of stress causing no fracture even by the stress application repeated $10^7$ times.

In addition, the notch portion was cut out from the test piece 10 after the carburization, and cut so that a vertical section thereof came into view. The section was mirror-polished and etched with a saturated picric acid solution, The "O" in the column of "presence or absence of coarse grain" in Table 2 represents that "coarsening of grains with a crystal grain size number of No. 3 or less was not observed " and the "X" represents that "coarsening of grains with a crystal grain size number of No. 3 or less occured".

As seen from the results shown in Table 2, in all Comparative Examples, coarse grains with a crystal grain size number of No. 3 or less were formed and occurrence of abnormal grain growth was observed. However, in all Examples, coarse grains with a crystal grain size number of No. 3 or less were not observed and abnormal grain growth 10 was not observed.

The crystal grain size difference in Table 2 represents the extent of variations in crystal grain size (size of crystal grains). A large crystal grain size difference means large variations in crystal grain size, and a small crystal grain size difference means small variations in crystal grain size. That is, it means that crystal grain sizes are uniform and the structure is a well-ordered grain structure.

The crystal grain size differences in Examples are small as compared to crystal grain size differences in Comparative Examples and are 6 or less. This means that individual crystal grains in each Example are relatively uniform in sizes.

The structure achieved by each Example is in a state where giant grain formation and abnormal grain growth are not observed and crystal grains are well-ordered in size in which the crystal grain size difference is 6 or less. Such a structure is obtained by controlling the total amount of TiC, AlN and ZrC, which are precipitate particles, to $4.5 \times 10^{-10}$ mole or less per 1 $mm^2$ of grain boundary area of prior austenite grains after carburization.

Figure 3:
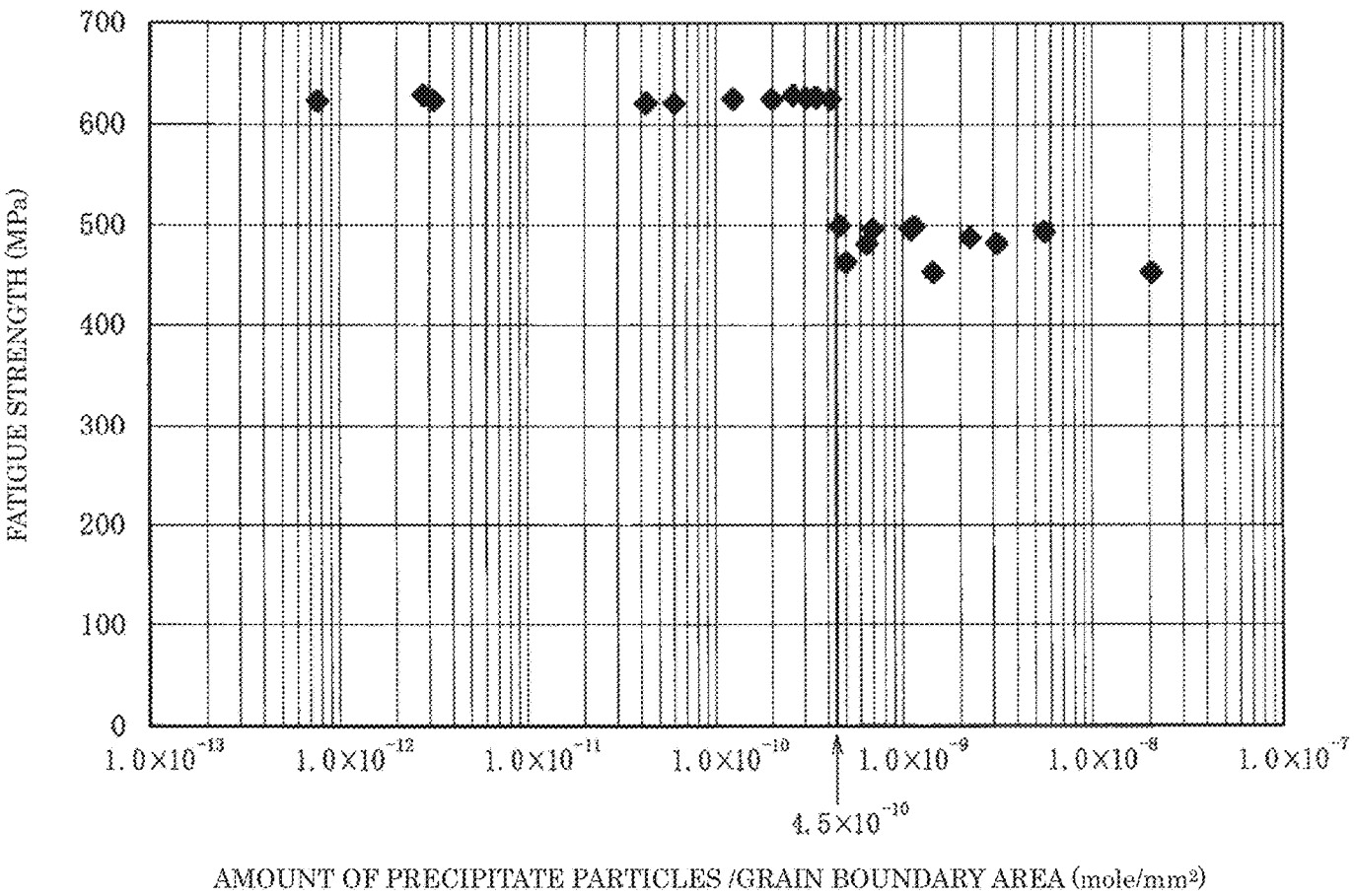
FIG. 3 is a diagram showing a relationship between the amount of precipitate particles per unit grain boundary area and fatigue strength.

In this manner, as shown in FIG. 3, the fatigue strength of carburized parts can be remarkably improved.

In addition, FIG. 3 is a graph obtained by plotting the fatigue strength values in Table 1 on ordinate and the amounts of precipitate particles per unit grain boundary area on abscissa, and shows a relationship therebetween.

As shown in the drawing, the fatigue strength value has remarkably differed based on $4.5\times10^{-10}$ mole of the amount of precipitate particles (precipitate density) as a boundary.

While the embodiments of the present invention have been described in detail above, these embodiments are merely examples, and various changes and modifications can be made therein.

INDUSTRIAL APPLICABILITY

According to the present invention, it is possible to provide a carburized part which allows effective inhibition of abnormal grain growth in spite of a carburizing treatment and makes it possible to solve the problem of reduction in properties caused by abnormal grain growth.

While the present invention has been described in detail and with reference to specific embodiments thereof, it will be apparent to one skilled in the art that various changes and modifications can be made therein without departing the spirit and scope thereof.

The present application is based on Japanese Patent Application No. 2013-134262 filed on Jun. 26, 2013, and Japanese Patent Application No. 2014-079166 filed on Apr. 8, 2014, the contents of which are incorporated herein by reference.

DESCRIPTION OF REFERENCE NUMERALS AND SIGNS p: Pinning particle
q: Crystal grain
Q: Giant crystal grain
10: Ono-type rotation bending fatigue test piece

The invention claimed is:

1. A carburized part having a total amount of TiC, AlN and ZrC, which are precipitate particles, of $4.5\times10^{-10}$ mole or less per 1 $mm^2$ of grain boundary area of prior austenite grains after carburization, which is formed by processing a steel material into a shape of a part and performing a carburizing treatment on the steel material, the steel material having a composition consisting of, in terms of % by mass:

0.10% to 0.30% of C;
0.01% to 0.49% of Si;
0.65% to 1.50% of Mn;
0.01% to 0.10% of S;
0.03% or less of P;
0.05% to 1.00% of Cu;
0.05% to 1.00% of Ni;
0.01% to 2.00% of Cr;
0.01% to 0.50% of Mo;
0.001% or less of Nb;
0.005% to 0.050% of s-Al;
0.005% to 0.030% of N; and
one or two elements selected from
0.001% to 0.150% of Ti and
0.001% to 0.300% of Zr,
and optionally:
0.001% to 0.010% of B,
with the remainder being Fe and inevitable impurities, wherein
[Ti], [Zr] and [N] which respectively represent contents of Ti, Zr, and N, in mole/g, satisfy the following equation (1):

$$|[Ti]/47.9+[Zr]/91.2-[N]/14|/100\leq3.5\times10^{-6}\ \text{mole/g} \quad \text{Equation (1);}$$

wherein at least one element selected from Ti and Zr combines with N included in the steel at the time of forging of the steel, and crystallizes in a form of at least one of TiN and ZrN having no contribution to a pinning of crystal grain boundaries to prevent AlN having a pinning action from being precipitated, and
a structure thereof after the carburization is a well-ordered grain structure having a uniform crystal grain size in which an average crystal grain size of the prior austenite grain is greater than 3 and 7.5 or less, and a crystal grain size difference of the prior austenite grains is 6 or less.

2. The carburized part according to claim 1, wherein the content of B is 0.001% to 0.010%.

3. The carburized part according to claim 1, wherein a driving force for crystal grain growth is greater than a pinning force of precipitate particles.

4. A carburized part having a total amount of TiC, AlN, and ZrC, which are precipitate particles, of $4.5\times10^{-10}$ mole or less per 1 $mm^2$ of grain boundary area of prior austenite grains after carburization, which is formed by processing a steel material into a shape of a part and performing a carburizing treatment on the steel material, the steel material having a composition consisting of, in terms of % by mass:

0.10% to 0.30% of C;
0.01% to 0.45% of Si;
0.40% to 1.50% of Mn;
0.01% to 0.10% of S;
0.03% or less of P;
0.05% to 1.00% of Cu;
0.05% to 1.00% of Ni;
0.01% to 2.00% of Cr;
0.01% to 0.50% of Mo;
0.001% or less of Nb;
0.001% to 0.008% of s-Al;
less than 0.001% of Ti;
less than 0.001% of Zr; and
0.005% to 0.030% of N,
and optionally:
0.001% to 0.010% of B,
with the remainder being Fe and inevitable impurities;
wherein the added amount of s-Al is sufficiently minute to prevent AlN having a pinning action from being precipitated, and
a structure thereof after the carburization is a well-ordered grain structure having a uniform crystal grain size in which an average crystal grain size of the prior austenite grain is greater than 3 and 7.5 or less, and a crystal grain size difference of the prior austenite grains is 6 or less.

5. The carburized part according to claim 4, wherein the content of B is 0.001% to 0.010%.

6. The carburized part according to claim 4, wherein a driving force for crystal grain growth is greater than a pinning force of precipitate particles.

* * * * *